US005907755A

United States Patent [19]

Takuma et al.

[11] Patent Number: 5,907,755

[45] Date of Patent: May 25, 1999

[54] DEVELOPING DEVICE

[75] Inventors: Yasuo Takuma; Yoshitaka Fujinuma; Masayasu Anzai; Hisao Okada, all of Ibaraki, Japan

[73] Assignee: Hitachi Koki Co., Ltd., Tokyo, Japan

[21] Appl. No.: 09/073,768

[22] Filed: May 7, 1998

[30] Foreign Application Priority Data

May 9, 1997 [JP] Japan ..... 9-119614

[51] Int. Cl.[6] ..... G03G 15/08

[52] U.S. Cl. ..... 399/252; 399/269

[58] Field of Search ..... 399/269, 267, 399/268, 272, 274, 252

[56] References Cited

U.S. PATENT DOCUMENTS

| | | | |
|---|---|---|---|
| 3,638,614 | 2/1972 | Young et al. | 399/269 |
| 4,063,533 | 12/1977 | White | 399/269 |
| 4,246,867 | 1/1981 | Hudson | 399/269 |
| 4,442,790 | 4/1984 | Swapceinski et al. | 399/269 |
| 4,679,527 | 7/1987 | Chang | 399/269 |
| 5,416,571 | 5/1995 | Yamada et al. | 399/269 |
| 5,630,201 | 5/1997 | Suzuki et al. | 399/269 |

*Primary Examiner*—Richard Moses
*Attorney, Agent, or Firm*—Sughrue, Mion, Zinn, Macpeak & Seas, PLLC

[57] ABSTRACT

A predetermined mathematical formula, which defines an occurrence degree of an image defect where the toner layer is thinned or no toner image is formed, is set up, which is valid for a developing device including a reverse turn developer carrier and a forward turn developer carrier. A difference between the total sum A of the values by the above formula showing the occurrence degree of the image defect on the forward turn developing roller and the total sum B of the values by the above formula showing the occurrence degree on the reverse turn developing roller, i.e., (A−B), is selected within a range of −0.56 to +0.5.

2 Claims, 6 Drawing Sheets x ; VALUE CALCULATED BY EQUATION (1)

y ; IMAGE DEFECT AT IMAGE END PORTION

DEVELOPING DEVICE

BACKGROUND OF THE INVENTION

1. Field of the Invention

The present invention relates to a developing device employed for an image forming apparatus, e.g., a laser printing machine and a copying machine in use with an electrophotographic picture.

2. Description of the Related Art

The image forming apparatus such as a laser printing machine and a copying machine in use with an electrophotographic picture basically takes a printing process including of 1) forming an electrostatic latent image on an image carrier (photosensitive body) rotatably supported, 2) supplying developer (toner particles) from a developing device onto the latent image to visualize the latent image as a toner image, and 3) transferring the toner image from the image carrier to a recording medium, e.g., a recording paper, and 4) fixing the toner image on the recording medium One of known developing devices that are applicable to this type of the image forming apparatus uses a developer having two components, toner particles and carrier particles.

The above developing device using the two-component developer will be described below. A two-component developer is mixed and blended in a developer container by stirring. During the mixing/blending process, the toner particles frictionally contact with the carrier particles, and those particles are charged to have a predetermined charge intensity. The thus charged developer is led from the developer container to a developer carrying member (developing roller), which includes a plural number of magnets, and is layered on the peripheral outer surface of the developing roller. With the rotation of the developing roller, the developer that is layered on the outer surface of the developing roller is moved forward under a doctor blade, which is disposed close to the outer surface of the developing roller. The developer is uniformly layered over the outer surface of the developing roller with the aid of the doctor blade when the developer moves under the blade. With a further turn of the developing roller, a uniform layer of developer is moved to a location (developing zone) being confronted with the surface of the latent image carrier. In the developing zone, a latent image formed on the image carrier is developed in a manner that the developer uniformly layered on the developing roller is brought into contact with the image carrier. At this time, a bias potential (referred to as a developing bias) has been applied to the developing roller so as to guide the developer to only an image area of the latent image, of the image area and a nonimage area. Under the developing bias, the developer is attracted to the image area of the latent image to develop or visualize the latent image.

The two-component developing device is devised in many varieties. One of these developing devices is a hybrid developing device. The hybrid developing device includes a plural number (e.g., two) of developing rollers oppositely disposed with respect to the developing zone. The rotating directions of the developing rollers are opposite to each other.

Terms "forward turn developing roller" and "reverse turn developing roller" will be used in the description of the hybrid developing device to follow. The "forward turn roller" means a developing roller which is rotated counterclockwise when the image carrier is rotated clockwise. The peripheral outer surfaces of both the rotary members move in the same direction when observed in the developing zone.

The "reverse turn developing roller" means a developing roller which is rotated in the same direction as of the image carrier. For example, when the image carrier is rotated clockwise, the "reverse turn developing roller" is also rotated clockwise. The moving directions of the peripheral outer surfaces of the rotating members are opposite to each other when observed in the developing zone.

In this type of the developing device, a ratio of a rotating speed of the developing roller to that of the image carrier, i.e., a peripheral speed ratio, is selected to be over 1.

Disadvantages of the conventional hybrid developing device will be described. When a toner image, which is formed through the developing process by only the forward turn developing roller, is observed, the toner layer is thinned and/or no toner layer is formed at the trailing end of the toner image, which is located upstream when viewed in the rotating direction of the image carrier. Therefore, the toner image is blurred at the trailing end. This image defect of the image will be referred to as a "trailing end blurring phenomenon".

On the other hand, the toner layer which is formed through the developing process by only the reverse turn developing roller is thinned and/or no toner layer is formed at the leading end of the toner image. Therefore, the toner image is blurred at the leading end. This image defect will be referred to as a "leading end blurring phenomenon".

Those image defects of the hybrid developing device can be indeed overcome in a manner that the forward turn developing roller supplementarily supplies toner particles to the defective portion, i.e., the toner-layer thinned leading end of the toner image developed by the reverse turn developing roller, while the reverse turn developing roller supplementarily supplies toner particles to the defective portion, i.e., the toner-layer thinned trailing end of the toner image developed by the forward turn developing roller.

However, this approach to overcome the image defects fails to achieve the above object in some setting conditions, however.

SUMMARY OF THE INVENTION

Accordingly, an object of the present invention is to provide a developing device which can prevent an occurrence of a toner image defect due to a leading end blurring phenomenon and a trailing end blurring phenomenon and give an image of high quality.

To solve the above object, there is provided a developing device including an image carrier rotatably supported; at least one of reverse turn developer carriers for supplying toner particles contained in a two-component developer to an electrostatic latent image formed on the image carrier, in a developing zone provided between each the reverse turn developer carrier and the image carrier, to thereby form a toner image on the image carrier, the reverse turn developer carriers rotating in the same direction as a rotating direction of the image carrier; and at least one of forward turn developer carriers for supplying the toner particles to the electrostatic latent image, in a developing zone provided between each the forward turn developer carriers and the image carrier, to thereby form a toner image on the image carrier, the forward turn developer carriers rotating in the direction opposite to the rotating direction of the image carrier. An occurrence degree of an image defect where the toner layer is thinned and/or no toner image is formed by each of the developer carriers is defined by the following equation:

$$X=\{K\cdot m\cdot(V0-VB)\}/\{n0\cdot G\cdot(VB-VR)\},$$

where

K: periphery speed ratio of each the developer carrier to the image carrier m: amount of developer passing each the developing zone ($g/cm^2$)

V0: potential in a nonimage area of an electrostatic latent image

VB: bias potential applied to each the developer carrier (V)

VR: potential in an image area of the latent image (V)

n0: true density of carrier particles contained in the two-component developer ($g/cm^3$)

G: gap between each the developer carrier and the image carrier (cm). Further, a difference between the total sum A of the values by the equation X showing the occurrence degree of the image defect on each the forward turn developer carrier and the total sum B of the values by the equation X showing occurrence degree on each the reverse turn developer carrier, i.e., (A–B), is selected within a range of −0.56 to +0.5.

BRIEF DESCRIPTION OF THE INVENTION

Similar reference characters denote corresponding features consistently throughout the attached drawings. The preferred embodiments of this invention will be described in detail, with reference too the following figures, wherein.

DETAILED DESCRIPTION OF THE PREFERRED EMBODIMENTS

The embodiments of the present invention, which are at present believed to be preferred, will be described with reference to the accompanying drawings.

Figure 1:
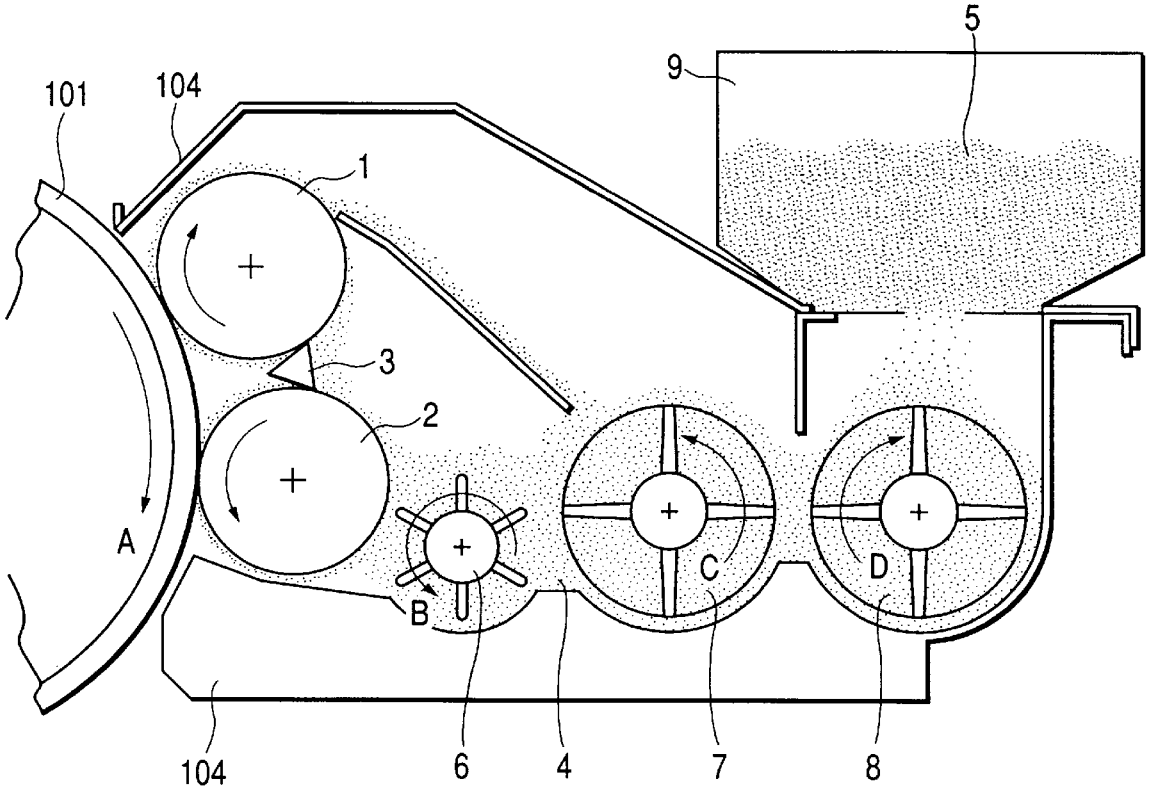
FIG. 1 is a schematic showing a construction of a developing device in a first embodiment of the present invention.
Figure 2:
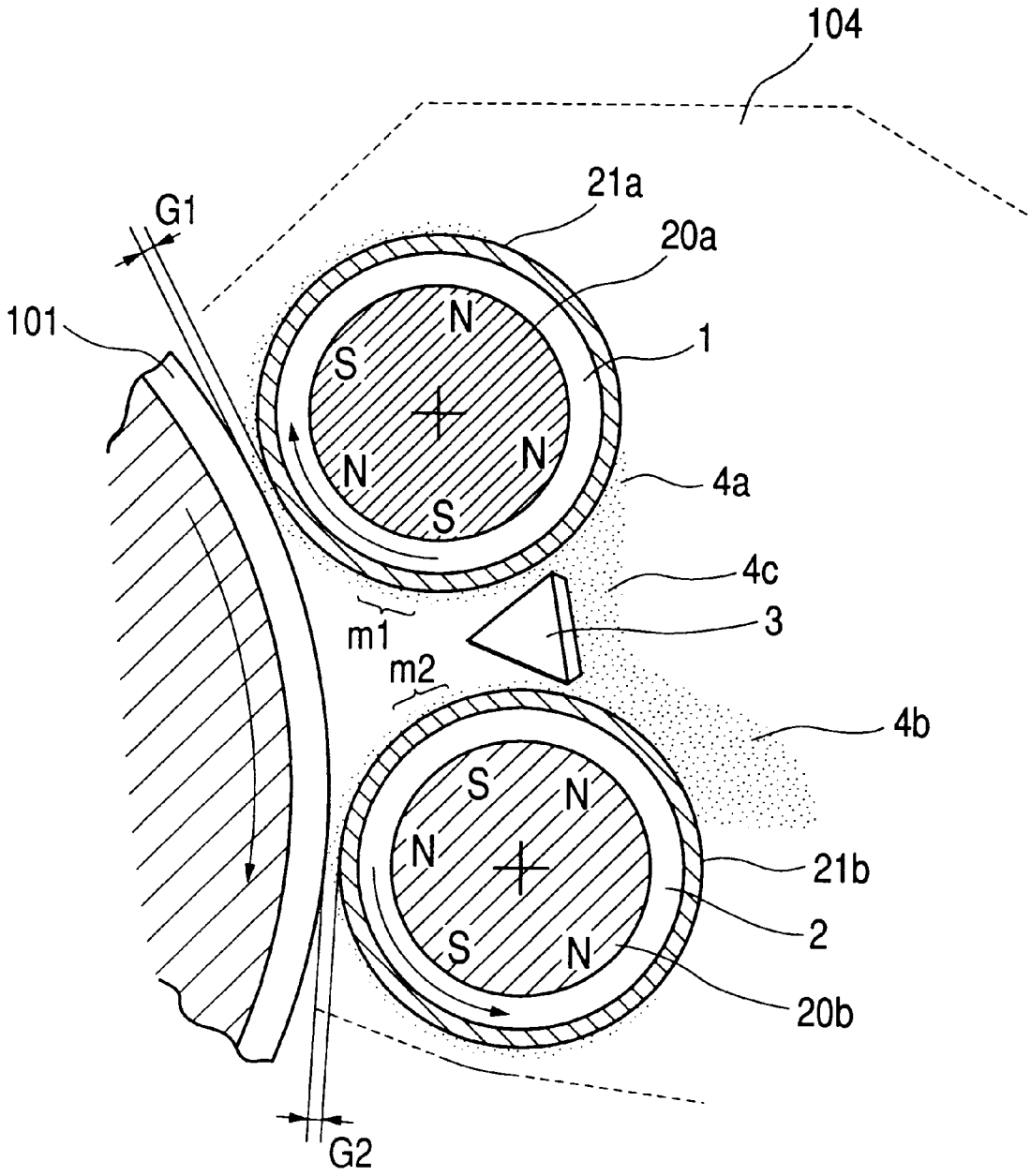
FIG. 2 is an enlarged view showing a main portion of the developing device in the first embodiment of the present invention.

Reference is first made to FIGS. 1 and 2 for describing a developing device which is a first embodiment of the present invention. FIG. 1 schematically illustrates the developing device of the first embodiments and FIG. 2 illustrates a main portion of the FIG. 1 developing device in an enlarged fashion. The developing device designated by reference numeral 104 includes two developing rollers 1 and 2, which are disposed close to and confronting with a photosensitive body 101. The developing roller 1 is disposed upstream when viewed in the rotating direction A of the photosensitive body 101 along the circumferential outer surface of the photosensitive body 101 and the developing roller 2 is disposed downstream. The developing roller 1 is a reverse turn developing roller which rotates in the same direction as the rotating direction of the photosensitive body 101 and the developing roller 2 is a forward turn developing roller which rotates in the direction opposite to the rotating direction of the photosensitive body 101.

In the developing device 104, a doctor blade 3 is disposed between the developing rollers 1 and 2. The doctor blade 3 regulates passing amounts of developers 4*a* and 4*b* provided on the developing rollers 1 and 2 (FIG. 2). In this instance, the weights of the developers 4*a* and 4*b* which have passed the doctor blade 3 are selected to be m1 and m2, respectively. The developers thus regulated are transported to the developing zones of those developing rollers. In this embodiment, the doctor blade 3 is constructed with a one-piece molded metal member, and the developers 4*a* and 4*b* are concurrently regulated in the passing amounts with the single doctor blade 3. If required, the doctor blade 3 may be separately constructed so as to be able to regulate the passing amounts of the developers 4*a* and 4*b* independently.

In the developing device shown in FIG. 1, the developer 4 contains a toner particles in the range of 2–3 wt %. Through the execution of image forming operation by a printer (not shown), only the toner particles are consumed, so that the weight percentage of the toner particles is reduced in the developer contained in the developing device 104. To replenish the developer whose toner particles were consumed with toner particles, the developing device 104 of this embodiment is provided with mixing/blending units 7 and 8. Those mixing/blending units 7 and 8 receive toner particles 5 from a toner storage/supply unit 9, and mixes and blends the toner particles 5 with the developer 4 by stirring. The mixing/blending units 7 and 8 respectively have spiral screws. Those spiral screws are rotated in the direction of arrows C and D (FIG. 2), so that the mixing/blending unit 7 forwards the developer 4 from this side to the back side (in the drawing) by stirring, and the mixing/blending units 8 forwards the developer 4 from the back side to this side. Through the toner stirring/forwarding operation of the mixing/blending units, the toner particles are uniformly distributed in the developer 4, viz., the weight percentage of the toner particles are uniformized in the developer 4. Further, through the toner stirring/forwarding operation, the toner particles frictionally contact with the carrier particles in the developer 4 to be charged to a predetermined charge intensity. This charge intensity of the toner particles is within the range from −10 $\mu$C/g to −20 $\mu$C/g in this embodiment.

The developer 4 is thus prepared to have a predetermined weight percent of toner particles and a predetermined charge intensity. Then, the developer 4 is forwarded to a toner transporting unit 6. With the rotation of the toner transporting unit 6 in the direction of an arrow B, the developer 4 is transported above the toner forwarding unit 6 from right to left (in the drawing) and led closely adjacent to the developing roller 2. Incidentally, magnets 20*a* and 20*b* are furnished to the developing rollers 1 and 2 (FIG. 2). Each of those magnets 20*a* and 20*b* is magnetized alternately to N and S poles. Sleeves 21*a* and 21*b* are rotatably supported on the circumferences of the developing rollers 1 and 2, respectively. The developer 4 being located closely adjacent to the developing roller 2 is magnetically attracted to the outer surface of the sleeve 21*b* by the magnet 20*b*. The developer 4 adhering onto the sleeve surface is transported to the doctor blade 3, with the rotation of the sleeve 21*b*.

Developer 4*b* shown in FIG. 2 is moved through a gap between the doctor blade 3 and the developing roller 2, so as to be regulated as a predetermined amount m2 on the outer surface of the developing roller 2, and led to the developing zone of the developing roller 2. A part or the whole of an developer 4*c* still left after the regulation of the passing amount by the doctor blade 3 is magnetically attracted to the outer surface of the sleeve 21*a* by the magnet 20*a*. With the rotation of the sleeve 21*a*, the excessive developer 4*c* shown in FIG. 2 is moved through a gap between the doctor blade 3 and the developing roller 1, so as to be regulated as a predetermined amount m1 on the outer surface of the developing roller 1, and led to the developing region of the developing roller 1.

In the present embodiment, OPC which is a negative charge is applied for the photosensitive body 101. The image area and the nonimage area on the surface of the photosensitive body 101 are respectively set at voltages VR and V0 in a step (not shown) of an image forming process before these areas reach the developing zones. Further, given bias potentials VB1 and VB2 are applied from a power source (not shown) to the developing rollers 1 and 2, respectively. Those voltages V0, VR, VB1 and VB2 are selected in value so as to satisfy the following conditions:

$$V0<VB1<VR<0 \text{ and } V0<VB2<VR<0.$$

Here, in the developing device 104 thus constructed according to the present invention, an image quality in the leading and trailing ends of the printed picture was evaluated with the visual observation, by changing the following parameters in the range of table 1 so that the combinations of the parameters satisfy the condition that an optical reflection density of a solid black image is in excess of 1.1.

TABLE 1

| Parameter | Range of valid parameter values |
|---|---|
| m1,m2 | 0.05~0.4 g/cm$^2$ |
| G1,G2 | 0.05~0.15 cm |
| K1,K2 | 1.3~3 |
| VB | −250~−500 V |
| V0 | −600~−800 V |
| VR | −30~−200 V |
| n0 | 4~6 g/cm$^3$ |
| vp | 15~50 cm/s |

In the above table, m1, m2, VB, V0, VR stated above

G1: gap between the photosensitive body 101 and the developing roller 1

G2: gap between the photosensitive body 101 and the developing roller 2

Vp: peripheral speed of the photosensitive body 101

K1: peripheral speed ratio of the developing roller 1 to the photosensitive body 101

K2: peripheral speed ratio of the developing roller 2 to the photosensitive body 101 n0: true density of the carrier particles contained in the developer

Figure 3:
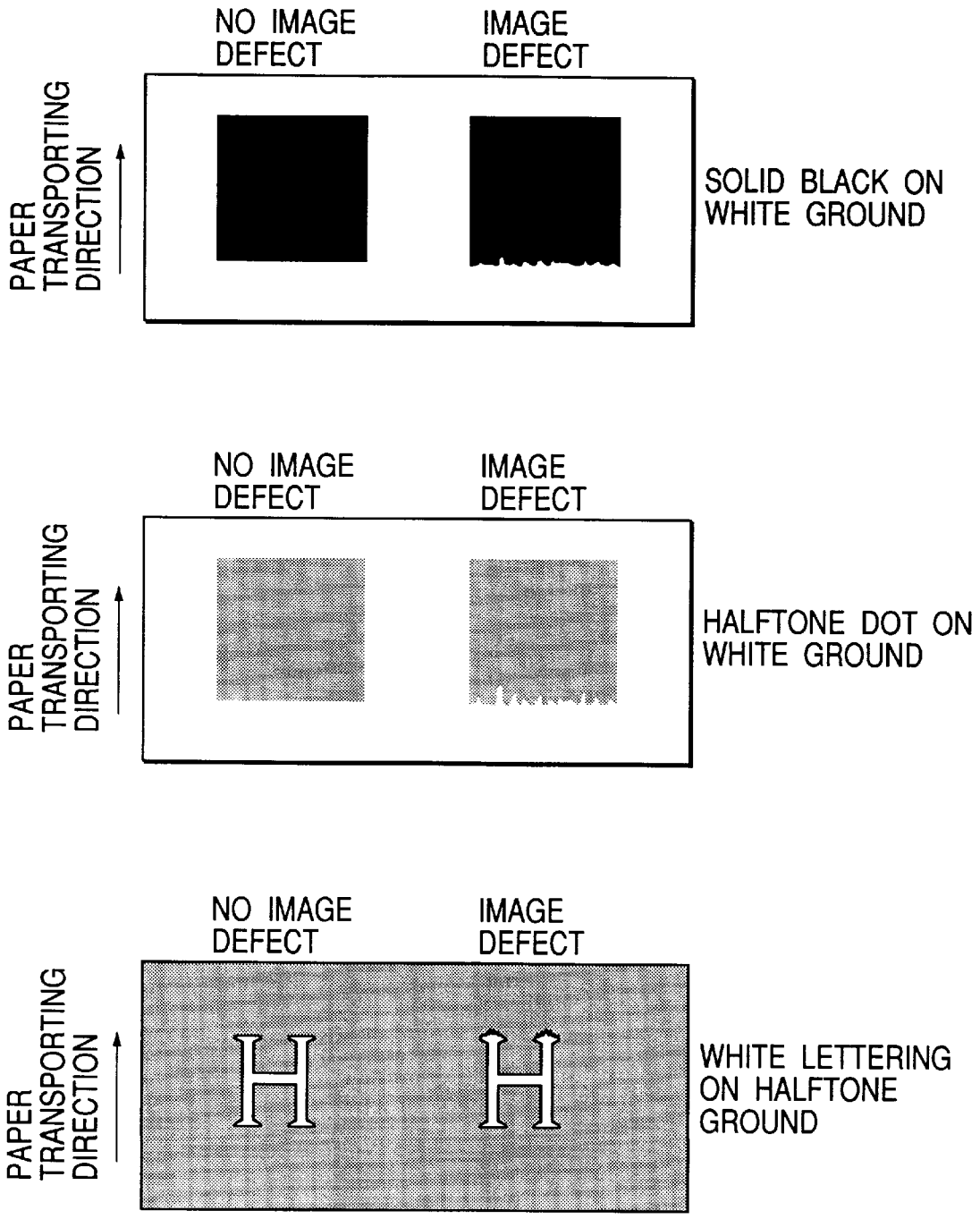
FIG. 3 is an explanation view for the evaluation of image qualities.

The three types of images were used for the image quality evaluation as shown in FIG. 3. Those images were a solid black image on the white ground, a halftone dot image on the white ground, and a white lettering on the halftone ground. As referred to above, the evaluation of the quality was based on the visible observation. Therefore, in the solid black image of the saturated reflection density, blur of image is almost imperceptible. On the other hand, in the case of the halftone image, the blur of image is readily perceived since its optical reflection density is relatively small. The white lettering on the halftone ground is applied for an evaluation on the image condition that the number of electric lines of force emanating from the nonimage area of the latent image and directed to the edge of the image area (to be described later) is large. An easiness of the perceiving of the image defect such as the blur of image may be ranked in the following order: 1) the white lettering on the halftone ground, 2) the halftone dot image on the white ground, and 3) the solid black image on the white ground. For the evaluation of those types of images above, the image defect was ranked in nine levels, level 0 to 8 as shown in Table 2. The image defect levels describe:

level 0: no image defect appears in any of the three types of pictures;

level 1: a faint image defect appears in only the white lettering on the halftone ground;

level 2: a faint image defect appears in the halftone dot on the white ground and the white lettering on the halftone ground;

level 3: a faint image defect appears in all of the three types of images;

level 4: a tolerable image defect appears in the halftone dot on the white ground and the white lettering on the halftone ground;

level 5: a tolerable image defect appears in all of the three types images;

level 6: a intolerable image defect appears in only the white lettering on the halftone ground, level 7: an intolerable image defect appears in the halftone image on the white ground and the white lettering on the halftone ground; and level 8: an intolerable image defect appears in all of the three types of images.

TABLE 2

| Defect level | Solid black on white ground | Halftone image on white ground | White lettering on halftone ground |
|---|---|---|---|
| 0 | ⊙ | ⊙ | ⊙ |
| 1 | ⊙ | ⊙ | ○ |
| 2 | ⊙ | ○ | ○ |
| 3 | ○ | ○ | ○ |
| 4 | ○ | Δ | Δ |
| 5 | Δ | Δ | Δ |
| 6 | Δ | Δ | x |
| 7 | Δ | x | x |
| 8 | x | x | x |

Note: ⊙—no image defect
○—faint image defect
Δ—tolerable image defect
x—intolerable image defect From Table 2, it is seen that the image defect becomes serious with increase of the defect level number, that the image defects of the defect level 5 or lower are tolerable, to thereby have the image of a high quality, and that the image defects of the defect level 3 or lower are negligible, to thereby have the image of a higher quality.

Figure 4A:
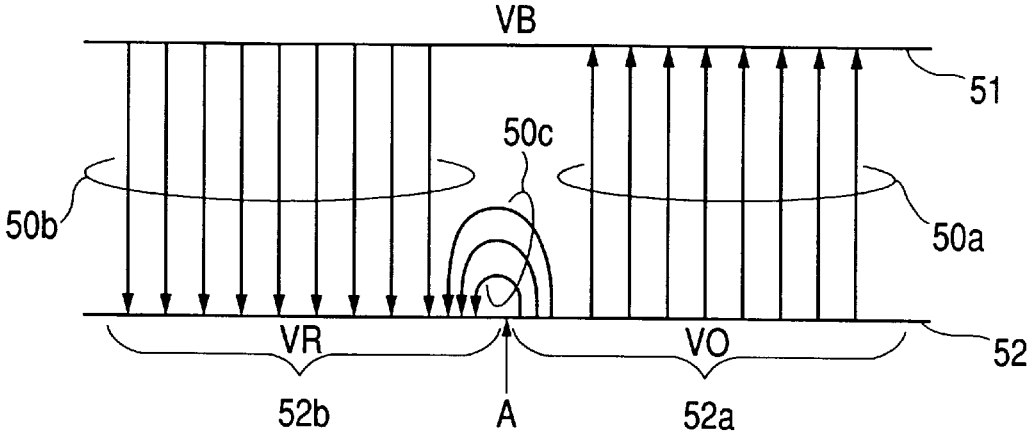
FIGS. 4A–4C are explanation views for explaining the cause of the image defects.
Figure 4B:
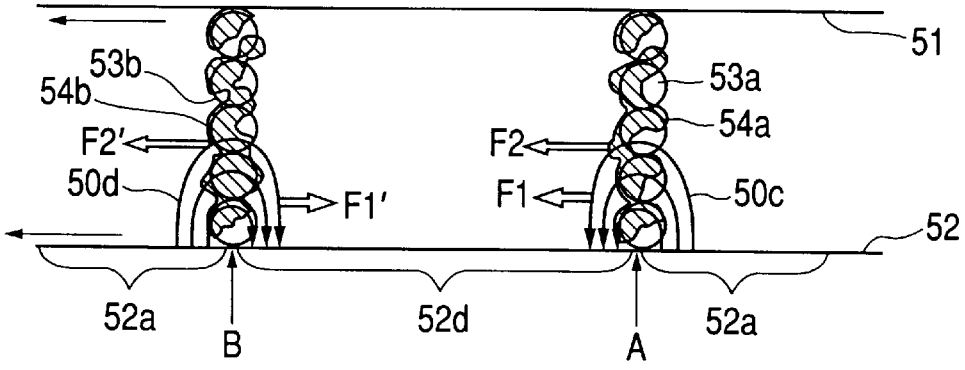

The correlation between the image defects at the leading and trailing ends of the formed image and the various operation conditions was scrutinized on the basis of the above evaluation conditions. The result of our scrutinization gives that the image defects appearing at the leading and trailing ends of the image basically depend on a ratio of (V0−VB) to (VB−VR) under the condition of a fixed amount of developer. The reason for this will be described with reference to FIGS. 4A and 4B. Incidentally, FIG. 4A shows a model of a relationship of potentials among an image area, a nonimage area on the photoreceptor, and the developing roller. FIG. 4B shows a model of forces exerting on toner particles at the leading and trailing ends of the image area.

In the illustration of FIG. 4A, three kinds of lines 50*a* to 50*c* of electric force are developed by the potential relationship among the image area potential VR, the nonimage area potential V0, and the developing bias VB. Here, reference numeral 50*a* shows lines of electric force directed from the nonimage area 52*a* to the developing roller 51; 50*b* shows lines of electric force directed from the developing roller 51 to the image area 52*b*; 50*c* shows lines of electric force directed from the nonimage area 52*a* to the image area 52*b* in the boundary zone A between the nonimage area 52*a* and the image area 52*b*. The number of electric lines 50*c* varies depending on the numbers of electric lines 50*a* and 50*b*. The numbers of electric lines 50*a* and 50*b* vary in proportional to the differences of potential between the originating points of those lines and the terminating points (i.e., (V0−VB) and (VB−VR)). Therefore, the ratio of (V0−VB) and (VB−VR) depends on the varying of the number of electric lines 50*c*. As a consequence, the image defect where the toner layer is thinned and/or no toner image is formed at the leading and trailing ends of the image so as to blur the image may be considered to be caused by the presence of the electric lines 50*c*.

However, in the case of the forward turn developing roller 51 shown in FIG. 4B, the electric lines 50*c* are developed not only in the boundary zone A including the trailing end of the formed image, located downstream of the forward turn developing roller 51 when viewed in the rotating direction of the roller, but also in another boundary zone B including the leading end of the image, located upstream of the developing roller 51. However, such an image defect is not observed in the leading end B. This depends on the fact that the moving directions of the developers 53*a* and 53*b* and the directions of the electric lines 50*c* and 50*d* are different from each other in the leading and trailing ends A and B. That is, in the trailing end A, the toner particles 54*a* of the developer 53*a* receives the electrostatic force F1 caused by the electric lines 50*c* and the moving force F2 whose direction is the same as the rotating direction of the developing roller 51. The direction of the electrostatic force F1 is the same as of the moving force F2. Those forces act to move the toner particles 54*a* toward the inner side of the image area 52*b*. As a result, the toner particles 54*a* do not adhere to the trailing end A, and the trailing end blurring phenomenon is created thereat. On the other hand, in the leading edge B, the toner particles 54*b* of the developer 53*b* receives the electrostatic force F1' caused by the electric lines 50*d* and the moving force F2' whose direction is the same as the rotating direction of the developing roller 51. The direction of the electrostatic force F1' is opposite to the direction of the moving force F2', and those forces are canceled. As a result, the toner particles 54*b* adhere to the leading edge B, to thereby create no leading end blurring phenomenon.

Thus, the moving forces F2 and F2' developed by the developer cause the image defect in the ends of image. Then, further scrutinization was made about the dependency of the image defect on the amount of the developer having passed the developing zone. The result is that the image defect depends on the product of a filling density of the developer in the developing zone and a ratio of the peripheral speed of the developing roller to the peripheral speed of the photosensitive body. Here, the term "filling density" means the result of dividing the weight of the developer per unit area in the developing zone by a gap between the developing roller and the photosensitive body. Our consideration on the reason why the image defect depends on those factors will be described below.

Figure 4C:
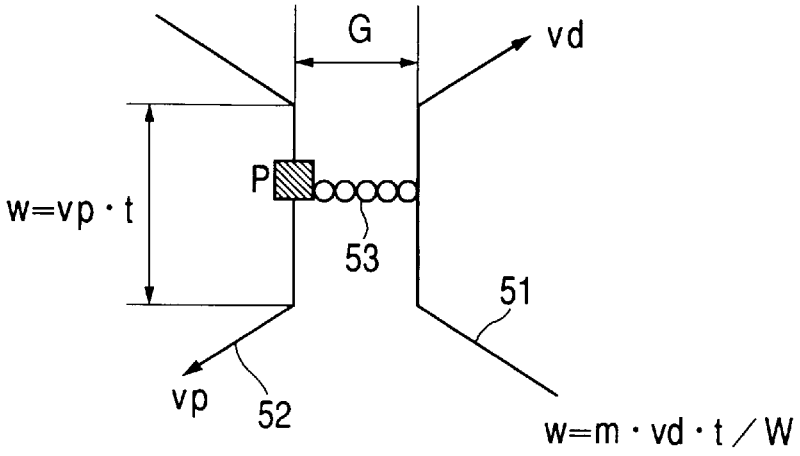

FIG. 4C typically shows the relationship between the developing roller and the photosensitive body to obtain a quantity of the developer contacting with the zone P, when the zone P on the photosensitive body 52 moves past the section W of the developing zone. The rotating directions of the developing roller 51 and the photosensitive body 52 are opposite to each other. A time t for the zone P to move the section W is expressed by t=W/vp (vp: peripheral speed of the photosensitive body 52). A total amount M of developer supplied to the contact section for the time t is expressed by $$M = m \cdot vd \cdot t / W$$
$$= m \cdot K$$

where m: amount of developer per unit area on the developing roller 51 vd: peripheral speed of the developing roller 51

K: a ration of the developing roller 51 to the photosensitive body 52 (=vd/vp).

It is considered that the result (=M/G) of dividing the developer total amount M by a length G of the gap between the photosensitive body 52 and the developing roller 51 indicates an amount of the developer contacting with the zone P when it has passed the section W.

As the contact developer amount increases, the image defect appearing at the end of the image increases. The developer amount at which the image defect occurs varies if a true density n0 of the carrier particles contained in the developer is varied. This fact teaches that the image defect occurrence depends on the result of dividing the ratio of M/G by the true density n0 of the carrier particles, viz., a volume ratio of the developer to the gap in the developing zone.

From the above description, it is seen that the image defect level for each developing roller is proportional to an magnitude of m·K/G/n0·(V0−VB)/(VB−VR). As recalled, in the developing device of this embodiment, the reverse turn developing roller 1 is disposed upstream when viewed in the rotating direction of the photosensitive body 101, and the forward turn developing roller 2 is disposed downstream. With this arrangement of the developing rollers, if the image defect appears at the leading end of the toner image developed by the reverse turn developing roller 1, it is mended through the development by the forward turn developing roller 2. Therefore, no image defect occurs with some exception. The trailing end of the latent image is developed by the reverse turn developing roller 1. Therefore, if it is not developed by the forward turn developing roller 2, no image defect appears thereat. If the image defect of the toner image developed by the reverse turn developing roller 1 is serious, its mending through the development by the forward turn developing roller 2 is incomplete, and the image defect is still left. The left image defect may be reduced by improving increasing the developing ability of the forward turn developing roller 2. The improvement of the developing ability is achieved by increasing the (m·K/G) already mentioned.

Therefore, on the toner image developed by the forward turn developing roller 2, the image defect at the trailing end thereof becomes worse with the improvement of the developing ability. To avoid this, it is necessary to set a state of the image defect at the leading end of the toner image developed by the reverse turn developing roller 1 to be within the defect level that can be handled for its image defect mending by the developing ability of the forward turn developing roller 2. This can be achieved in a manner that a difference between m1·K1/G/n0·(V0−VB1)/(VB1−VR) for the reverse turn developing roller 1 and m2·K2/G/n0·

(V0−VB2)/(VB2−VR) for the reverse turn developing roller 2 is selected to be within a predetermined range of values. The effect obtained by selecting the difference with such a range is valid for the case where the number of developing rollers is increased.

The image defect formation theory thus far described may be mathematically expressed by the following equation (1):

$$x = \sum_{s=1}^{s} \frac{K(s)m2(s)\{V0 - VB(s)\}}{n0G2(s)\{VB(s) - VR\}} - \sum_{t=1}^{t} \frac{K(t)m1(t)\{V0 - VB(t)\}}{n0G1(t)\{VB(t) - VR\}} \quad (1)$$

where s: roll number of the developing roller whose rotating direction is the same as of the developing roller located most downstream t: roll number of the developing roller whose rotating direction is opposite to the rotating direction of the developing roller located most downstream K(s), K(t): periphery speed ratio of each developing roller to the photosensitive body (absolute value)

m2(s), m1(t): amount of developer having passed the developing zone of each developing roller (g/cm$^2$)

G2(s), G1(t): gap between each developing roller and the photosensitive body (cm)

VB(s), VB(t): bias potential applied to each developing roller (V)

n0: true density of the carrier particles contained in the developer (g/cm$^3$)

V0, VR: potential in nonimage area potential, potential in image area (V)

The equation (1) is valid for a developing device in which an s number of developing rollers whose rotating directions are the same as of a developing roller located downstream when viewed in the rotating direction of the photosensitive body are combined with a t number of developing rollers whose rotating direction is opposite to the rotating direction of the downstream developing roller. In the developing device of the first embodiment thus described, s is the forward turn developing roller, t is the reverse turn developing roller, and s=t=1.

Figure 5:
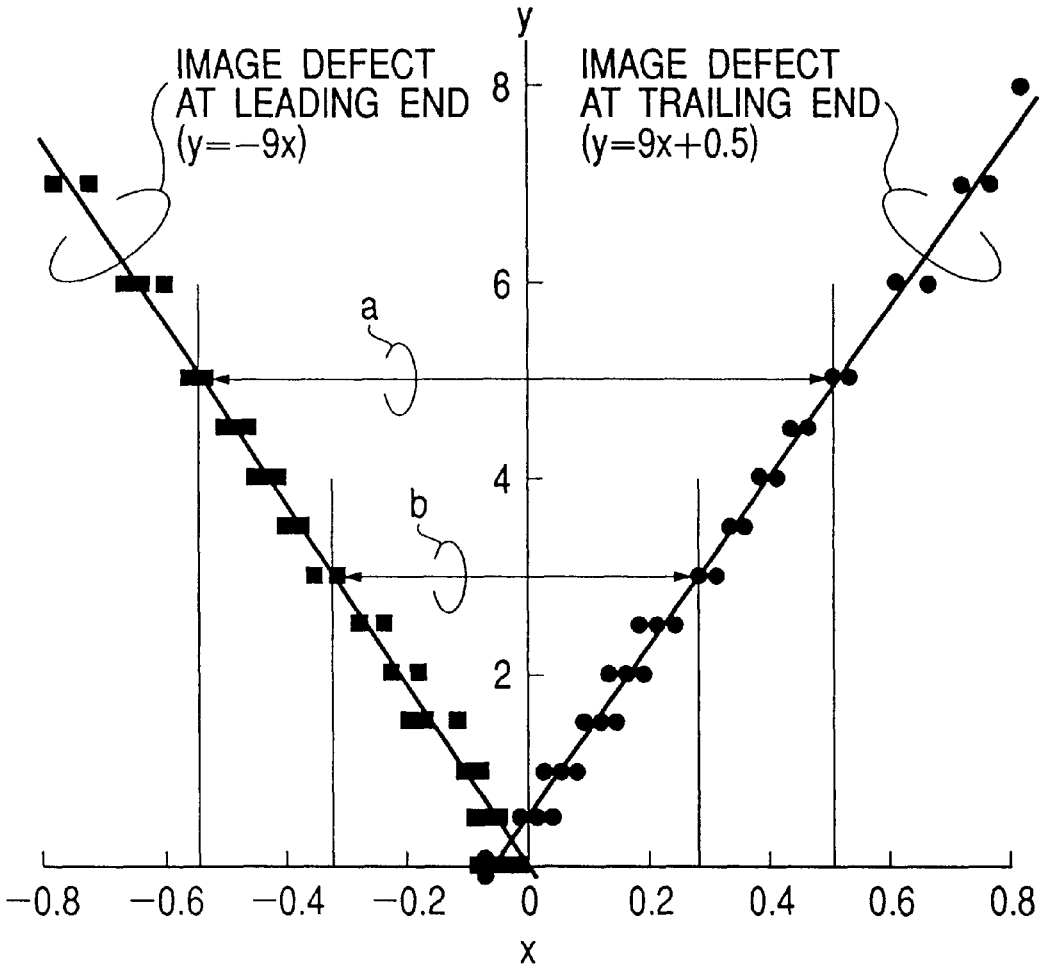
FIG. 5 is an explanation view showing the results of the evaluations of the image defects in the developing device of the first embodiment.

Defect levels of the image defects in the image formed by using the developing device of the first embodiment were plotted against the values of X computed using the equation (1). The result is shown in FIG. 5. In FIG. 5, the level of the image defect 0.5 represents a state which cannot decide to be the level 0 or 1, the level of the image defect 1.5 represents a state which cannot decide to be the level 1 or 2, and the level of the image defect 4.5 represents a state which cannot decide to be the level 4 or 5. In addition, the level of the image defect 3.5 represents a state which cannot decide to be the level 3 or 4, and thus includes a state which solid black on white ground, halftone image on white ground and white lettering on halftone ground are respectively faint image defect, faint image defect and tolerable image defect.

As seen from the graph of FIG. 5, the image defect levels are uniformly varied with respect to the value X of the equation (1). At an equal absolute value of X, the defect level of the image defect at the trailing end of the printed image is somewhat larger than that of the image defect at the leading end. This is due to the fact that, at the trailing end of the toner image, after the latent image is developed by the reverse turn developing roller 1, an image defect is created by the forward turn developing roller 2, while, at the leading end of the toner image, after an image defect is created by the reverse turn developing roller 1, the defective part of the toner image leaving the developing roller 1 is subjected to the developing process by the forward turn developing roller 2. That is, the training end image defect is caused by a process in which the toner particles do not adhere to the trailing end, and additionally the toner particles having adhered to the trailing end are stripped off therefrom. The leading end image defect is caused by such a simple process that the toner particles fail to adhere to the trailing end of the image. In other wards, the leading end image defect is corrected by the following forward turn developing roller. On the other hand, the trailing end image defect caused by stripping off the toner particles adhered once is not corrected, because of having no following developing roller.

As a result, a range of values of X where neither the leading end image defect or the trailing end image defect is created is slightly shifted to the negative side. When the values of X given by the equation (1) were set within the range from −0.56 to +0.5, the image defects could be all within tolerable defect levels of level 5 or lower. When the values of X were set within the range from −0.34 to +0.28, the image defects could be all within the defect level 3 or lower, which indicates a faint image defect. Specially, taking the successive variation of each parameter applied for calculating the value X into consideration, it is desirable that the value X is set to be negative so as to control the image defect more stably.

The developing device 104 was designed on the basis of the image defect theory described above, and incorporated into an image forming apparatus. In the resultant image, the images with a high quality in which the defect level is 3 or lower and the reflection density of a solid image was 1.4 or higher were attained. Specifications of the developing device 104 were: the peripheral speed vp of the photosensitive body 101 was 30 cm/s; the peripheral speed ratio K1 and K2 of the developing rollers 1 and 2 to the photosensitive body were each 1.8; the image area potential VR was −50V; the nonimage area potential V0 was −680V; the developing bias voltages VB1 and VB2 of the developing rollers 1 and 2 were each −400V; the gap lengths G1 and G2 between the developing rollers 1 and 2 and the photosensitive body 101 were each 0.08 cm; the true density n0 of the carrier particles was 5 g/cm$^3$; the weight percent of the toner particles in the developer was 2.5%; charge density level of the toner particles was −12 $\mu$C/g to −16 $\mu$C/g; and the quantities m1 and m2 of the developer having passed the developing zones of the developing rollers 1 and 2 were 0.125 g/cm$^2$ to 0.2 g/cm$^2$.

Figure 6:
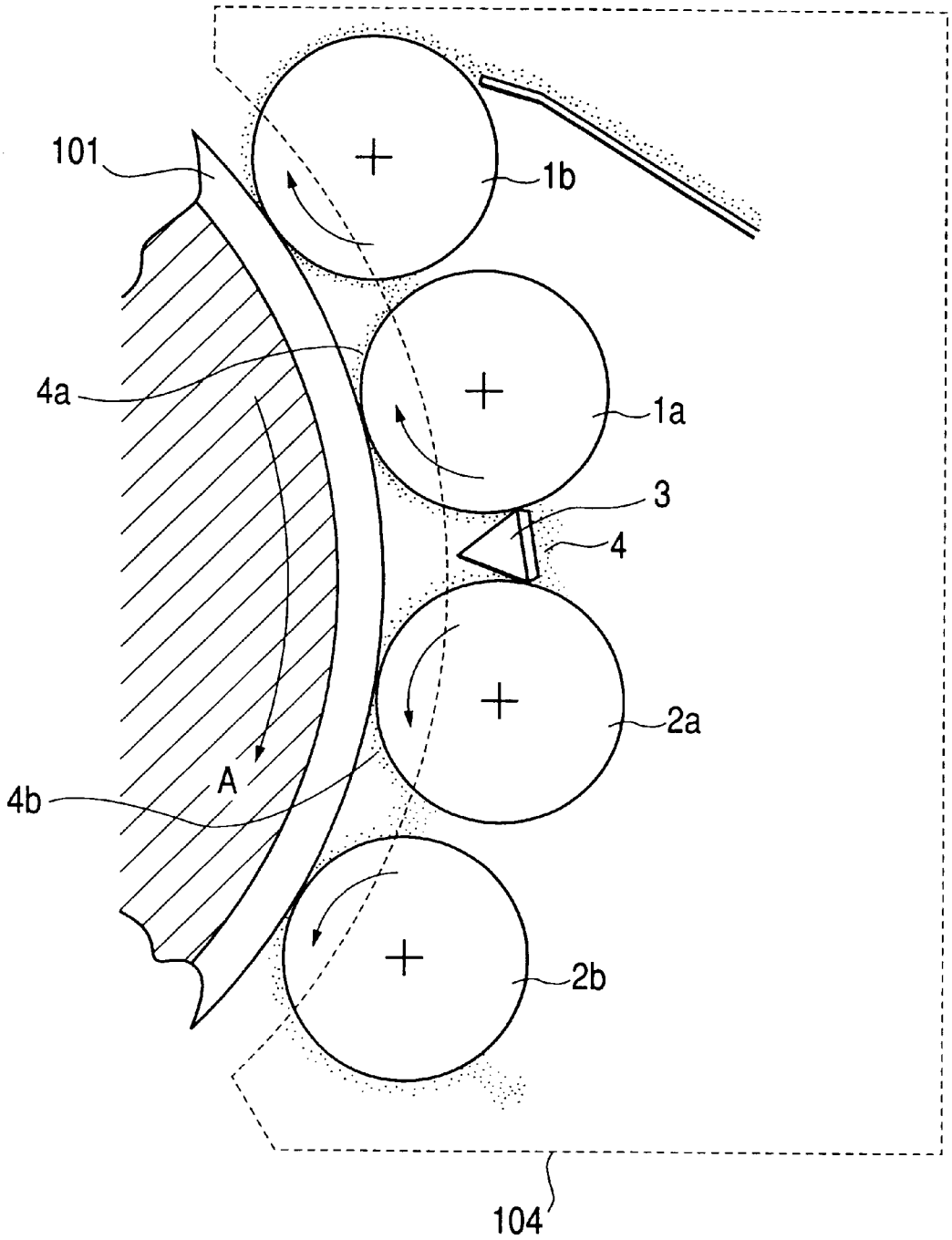
FIG. 6 is a schematic showing a construction of a developing device in a second embodiment of the present invention.

A main portion of a developing device which constitutes a second embodiment of the present invention is schematically illustrated in FIG. 6. A developing device 104 of the second embodiment is constructed such that a couple of developing rollers 2*a* and 2*b*, which rotate in the same direction as the rotating direction (indicated by arrow A) of the photosensitive body 101 are located downstream when viewed in the rotating direction of a photosensitive body 101, and another couple of developing rollers 1*a* and 1*b*, which rotate in the direction opposite to the rotating direction of the photosensitive body 101, are located upstream.

A doctor blade 3 is located between the developing rollers 1*a* and 2*a* in the structure of the developing device 104. The doctor blade 3 regulates the amount of developer feeding to the developing zones of the developing rollers 1*a* and 2*a*.

The developer passes the developing zone of the developing roller 1*a*, is then fed to the developing roller 1*b*, it passes the developing zone of the developing roller 1*b*; and then it is returned to a proper location within the developing device 104. Similarly, the developer passes the developing zone of the developing roller 2*a*, is then fed to the developing roller 2*b*, it passes the developing zone of the developing roller 2*b*; and then it is returned to the same location within the developing device 104.

In the developing device of the second embodiment, s=2 and t=2 in the equation (1). Also in this embodiment, when the values of X given by the equation (1) were set within the range from −0.56 to +0.5, the image defects could be all within tolerable defect levels of level 5 or lower. When the values of X were set within the range from −0.34 to +0.28, the image defects could be all within the defect level 3 or lower, which indicates a faint image defect.

In the second embodiment, the reverse turn developing rollers, which rotate in the same direction as the rotating direction of the photosensitive body 101, are located downstream, while the forward turn developing rollers, which rotate in the direction opposite to the rotating direction of the photosensitive body, are located upstream. If required, the reverse turn developing rollers may be located upstream, while the forward turn developing rollers may be located downstream The modification can also attain the image with a high quality, which is free from the image defects if the values of X are set within the above mentioned ranges.

[Effects of the Invention]

As seen from the foregoing description, the developing device constructed according to the present invention succeeds in developing an electrostatic latent image into a toner image whose leading and trailing ends are free from the image defects.

What is claimed is:

1. A developing device comprising:

an image carrier rotatably supported;

at least one of reverse turn developer carriers for supplying toner particles contained in a two-component developer to an electrostatic latent image formed on said image carrier, in a developing zone provided between each said reverse turn developer carrier and said image carrier, to thereby form a toner image on said image carrier, said reverse turn developer carriers rotating in the same direction as a rotating direction of said image carrier; and at least one of forward turn developer carriers for supplying the toner particles to the electrostatic latent image, in a developing zone provided between each said forward turn developer carriers and said image carrier, to thereby form a toner image on said image carrier, said forward turn developer carriers rotating in the direction opposite to the rotating direction of said image carrier;

wherein 1) an occurrence degree of an image defect where the toner layer is thinned and/or no toner image is formed by each of said developer carriers is defined by the following equation:

$$X=\{K\cdot m\cdot(V0-VB)\}/\{n0\cdot G\cdot(VB-VR)\},$$

where

K: periphery speed ratio of each said developer carrier to said image carrier m: amount of developer passing each the developing zone ($g/cm^2$)

V0: potential in a nonimage area of an electrostatic latent image

VB: bias potential applied to each said developer carrier (V)

VR: potential in an image area of the latent image (V)

n0: true density of carrier particles contained in the two-component developer ($g/cm^3$)

G: gap between each said developer carrier and said image carrier (cm), and 2) a difference between the total sum A of the values by the equation X showing the occurrence degree of the image defect on each said forward turn developer carrier and the total sum B of the values by the equation X showing occurrence degree on each said reverse turn developer carrier, i.e., (A−B), is selected within a range of −0.56 to +0.5.

2. A developing device comprising:

an image carrier rotatably supported;

at least one of reverse turn developer carriers for supplying toner particles contained in a two-component developer to an electrostatic latent image formed on said image carrier, in a developing zone provided between each said reverse turn developer carrier and said image carrier, to thereby form a toner image on said image carrier, said reverse turn developer carriers rotating in the same direction as a rotating direction of said image carrier; and at least one of forward turn developer carriers for supplying the toner particles to the electrostatic latent image, in a developing zone provided between each said forward turn developer carriers and said image carrier, to thereby form a toner image on said image carrier, said forward turn developer carriers rotating in the direction opposite to the rotating direction of said image carrier;

wherein 1) an occurrence degree of an image defect where the toner layer is thinned and/or no toner image is formed by each of said developer carriers is defined by the following equation:

$$X=\{K\cdot m\cdot(V0-VB)\}/\{n0\cdot G\cdot(VB-VR)\},$$

where

K: periphery speed ratio of each said developer carrier to said image carrier m: amount of developer passing each the developing zone ($g/cm^2$)

V0: potential in a nonimage area of an electrostatic latent image

VB: bias potential applied to each said developer carrier (V)

VR: potential in an image area of the latent image (V)

n0: true density of carrier particles contained in the two-component developer ($g/cm^3$)

G: gap between each said developer carrier and said image carrier (cm), and 2) the total sum A of the values by the equation X showing the occurrence degree of the image defect on each said forward turn developer carrier and the total sum B of the values by the equation X showing occurrence degree on each said reverse turn developer carrier, are selected to have the following relation:

$$A<B.$$

* * * * *